US008304997B2

(12) United States Patent
Kim et al.

(10) Patent No.: US 8,304,997 B2
(45) Date of Patent: Nov. 6, 2012

(54) ENERGY RECOVERY CIRCUIT FOR PLASMA DISPLAY PANEL

(75) Inventors: Yong Duk Kim, Gumi-si (KR); Young Jun Lee, Gumi-si (KR); Su Sam Choi, Gumi-si (KR)

(73) Assignee: Orion Co., Ltd. (KR)

( * ) Notice: Subject to any disclaimer, the term of this patent is extended or adjusted under 35 U.S.C. 154(b) by 305 days.

(21) Appl. No.: 12/733,716

(22) PCT Filed: Sep. 22, 2008

(86) PCT No.: PCT/KR2008/005609

§ 371 (c)(1),
(2), (4) Date: Mar. 16, 2010

(87) PCT Pub. No.: WO2009/038419

PCT Pub. Date: Mar. 26, 2009

(65) Prior Publication Data

US 2010/0207550 A1 Aug. 19, 2010

(30) Foreign Application Priority Data

Sep. 20, 2007 (KR) ..... 10-2007-0095981
Sep. 20, 2007 (KR) ..... 10-2007-0095992

(51) Int. Cl.
*G09G 3/10* (2006.01)

(52) U.S. Cl. ..... 315/169.4; 345/66

(58) Field of Classification Search ..... 345/204, 345/60, 66; 315/169.4
See application file for complete search history.

(56) References Cited

U.S. PATENT DOCUMENTS

| | | | | |
|---|---|---|---|---|
| 7,375,722 | B2 * | 5/2008 | Kigo et al. | 345/204 |
| 7,598,932 | B2 * | 10/2009 | Shin et al. | 345/60 |
| 7,633,467 | B2 * | 12/2009 | Cho et al. | 345/60 |
| 2006/0208968 | A1 * | 9/2006 | Moon | 345/60 |

* cited by examiner

*Primary Examiner* — Thuy Vinh Tran
(74) *Attorney, Agent, or Firm* — Head, Johnson & Kachigian, P.C.

(57) ABSTRACT

An energy recovery circuit for a plasma display panel (PDP) according to the present invention includes an energy recovery unit recovering and storing energy from the PDP; and a switching stabilizing unit electrically connected to the energy recovery unit to stabilize switching of a sustain discharge pulse applied to the PDP. The switching stabilization unit may include one diode, two switches and one capacitor for energy recovery, or include two switches and an external input voltage source that is an external voltage supply. According to the present invention, the difference of voltages applied to both drain and source terminals of a switch (SW2) for applying a sustain discharge voltage (Vsus) is minimized at the time when the switch (SW2) is switched, so that switching can be stabilized by preventing hard switching from being generated when the sustain discharge voltage is applied to a panel. Further, switching and electro-magnetic interference (EMI) noises of the circuit, generated due to the hard switching can be decreased, and therefore, driving reliability of the circuit can be improved.

12 Claims, 10 Drawing Sheets

ENERGY RECOVERY CIRCUIT FOR PLASMA DISPLAY PANEL

CROSS-REFERENCE TO RELATED APPLICATIONS

This application is a national phase application of PCT International Application No. PCT/KR2008/005609 which claims priority to Korean Patent Application No. 10-2007-0095981 filed Sep. 20, 2007 and Korean Patent Application No. 10-2007-0095992 filed Sep. 20, 2007.

TECHNICAL FIELD

The present invention relates to a plasma display panel (PDP), and more particularly, to an energy recovery circuit for a PDP, which can stabilize switching by preventing hard switching of a sustain discharge pulse voltage.

BACKGROUND ART

A plasma display panel (PDP) is a display device that excites phosphors formed on an inner wall of a cell with vacuum ultraviolet light generated by gas discharge in the cell to generate visible light and express lighting. The PDP is divided into an alternating current (AC) type and a direct current (DC) type according to a discharge mechanism. Currently, an AC three-electrode surface discharge PDP is mainly employed among AC PDPs. The AC three-electrode surface discharge PDP induces gas discharge and light emission of a cell by alternately applying a high voltage of a high frequency between scan and sustain electrodes in a sustain discharge period.

In a sustain discharge circuit of the three-electrode surface discharge PDP, a high voltage of about 200 V is alternately applied to electrodes X and Y of the panel. Since a capacitor exists between the electrodes X and Y, a large amount of consumption power is required to charge or discharge the capacitor.

As the size of the PDP increases, the power consumption of the PDP also increases. Therefore, it is very important to develop a method for saving the power consumption. The method for saving the power consumption is determined by the physical structure of a device and the optimization of a discharge gas. Two methods are required to save power consumption when the panel is driven. A first method is a method for saving power consumption of a circuit itself by preventing heat from being generated from an unnecessary circuit, and a second method is a method for minimizing the supply of displacement current that is unrelated to discharge of the panel. To this end, an energy recovery circuit is used to minimize energy consumption by recovering energy applied to a panel from a power supply and using the recovered energy as displacement current before a sustain discharge voltage is applied.

A conventional energy recovery circuit 10 was proposed by Larry F. Weber. As shown in FIG. 1, the conventional energy recovery circuit includes a capacitor CR for energy recovery, that recovers and stores energy; two control switches SW1 and SW2 that supply the recovered energy and recover the energy applied to a panel CP; two diodes D1 and D2 for preventing reverse current; and an auxiliary inductor LR that induces a stable voltage pulse waveform by preventing current from being increasing rapidly in a process of supplying or recovering energy.

In the energy recovery circuit 10 of FIG. 1, energy supplied to the panel CP from a power supply is recovered to the capacitor CR for energy recovery. Before a sustain discharge pulse is applied, the recovered energy is applied again as a displacement current component to the panel CP, thereby reducing the load of the power supply. In FIG. 1, CP designated as a capacitor denotes a panel. The panel CP is typically expressed as a capacitor. Both ends of the panel are connected to electrodes X and Y, respectively. The electrodes X and Y are simply expressed as nodes X and Y, respectively.

The operation of the conventional energy recovery circuit 10 will be described as divided into four periods T1 to T4. The first period T1 is a period for supplying displacement current to the panel. It is assumed that a voltage Vcr charged into the capacitor CR for energy recovery by continuous charge and discharge of energy is a half of a sustain discharge voltage Vsus, i.e., ½ Vsus. In order to supply the voltage Vcr to the capacitor of the panel CP, a first switch SW1 is turned on by a first switch control signal of a high level, and second, third and fourth switches SW2, SW3 and SW4 are turned off by second, third and fourth switch control signals of a low level, respectively. At this time, current flows sequentially into the panel CP through the first switch SW1, the first diode D1 and the auxiliary inductor LR. Accordingly, a sustain discharge pulse voltage formed at one terminal of the panel CP, i.e., the node Y, is increased by resonance of the auxiliary inductor LR and the capacitor of the panel CP. Theoretically, the sustain discharge pulse voltage rises up to the sustain discharge voltage Vsus. The first diode D1 prevents flow of reverse current as a blocking diode for blocking the resonance of the capacitor of the panel CP and the auxiliary inductor LR.

The second period T2 is a period for supplying discharge current. The second switch SW2 is turned on by a second switch control signal of a high level, and the first, third and fourth switches SW1, SW3 and SW4 are turned off by first, third and fourth switch control signals of a low level, respectively. At this time, the first switch SW1 may be turned on by the first switch control signal of a high level. In this state, the sustain discharge voltage Vsus is directly supplied to the panel CP through the second switch SW2 from a power supply (not shown). Accordingly, the sustain discharge pulse voltage at the node Y is maintained continuously as the sustain discharge voltage Vsus.

The third period T3 is an energy recovery period. The voltage at the node Y is decreased down to a ground voltage GND. In order to recover the energy applied to the capacitor of the panel CP to the capacitor CR for energy recovery, the third switch SW3 is turned on by a third switch control signal of a high level, and the first, second and fourth switches SW1, SW2 and SW4 are turned off by first, second and fourth switch control signals of a low level, respectively. At this time, current flows sequentially into the capacitor CR for energy recovery through the auxiliary inductor LR, the second diode D2 and the third switch SW3. Accordingly, the sustain discharge pulse voltage at the node Y is decreased down to the ground voltage GND by the resonance of the auxiliary inductor LR and the capacitor of the panel CP. The second diode D2 is a blocking diode for blocking the resonance of the capacitor of the panel CP and the auxiliary inductor LR.

The fourth period T4 is a period for maintaining the sustain discharge pulse voltage at the node Y as the ground voltage GND. The fourth switch SW4 is turned on by a fourth switch control signal of a high level, and the first, second and third switches SW1, SW2 and SW3 are turned off by first, second and third switch control signals of a low level, respectively. The sustain discharge pulse voltage at the node Y is maintained as the ground voltage GND. At this time, the third switch SW3 may be turned on by the third switch control signal of a high level. In this state, the sustain discharge voltage Vsus is applied to the electrode X of the panel.

As described above, in the conventional energy recovery circuit 10, energy supplied to the panel CP is recovered to the capacitor CR for energy recovery, and the recovered energy is supplied again to the panel CP, so that an amount of energy supplied from the power supply can be minimized. That is, current required for discharge of the panel is not applied from the power supply, but the energy recovered after discharge is supplied again to the panel, so that the amount of power supplied to the panel from the power supply can be reduced.

Theoretically, it is assumed that a voltage VR charged into the capacitor CR for energy recovery corresponds to ½ of the sustain discharge voltage Vsus, and the energy recovery circuit has no energy loss. In the conventional energy recovery circuit 10, the sustain discharge pulse voltage can be increased up to the sustain discharge voltage Vsus by the ideal LC resonance of the inductor LR and the capacitor of the panel CP, and energy required for increasing the sustain discharge pulse voltage can be supplied from the capacitor CR for energy recovery.

Actually, however, due to a resistance component that exists in the energy recovery circuit 10 and energy loss caused by a switching device, the voltage at the node Y cannot rise up to the sustain discharge voltage Vsus in the first period T1, and perfect soft switching, i.e., zero-voltage zero-current switching is impossible, as shown in FIG. 3. Furthermore, discharge is frequently generated in the first period T1 in which the voltage at the node Y rises, and discharge current required for discharge is insufficiently supplied from the energy recovery circuit 10. Therefore, as a voltage drop is seriously generated, hard switching is more seriously generated. In addition, switching and electro-magnetic interference (EMI) noises of the circuit are seriously generated. As a result, driving reliability of the energy recovery circuit is lowered.

In order to solve these problems, it is required to develop an energy recovery circuit capable of increasing driving reliability of the circuit and improving energy recovery efficiency by achieving stable soft switching.

DISCLOSURE OF INVENTION

Technical Problem

Therefore, the present invention has been made in view of the above problems, and provides an energy recovery circuit for a plasma display panel (PDP), which can stabilize switching of a sustain discharge pulse by preventing hard switching of the sustain discharge pulse.

The present invention also provides an energy recovery circuit for a PDP, which can increase energy recovery efficiency and improve driving reliability of the circuit.

Technical Solution

In accordance with an aspect of the present invention, there is provided an energy recovery circuit for a plasma display panel (PDP), including: an energy recovery unit recovering and storing energy from the PDP; and a switching stabilizing unit electrically connected to the energy recovery unit to stabilize switching of a sustain discharge pulse applied to the PDP.

When energy is recovered from the PDP, the switching stabilization unit may allow a first capacitor for energy recovery of the energy recovery unit and a second capacitor for energy recovery of the switching stabilization unit to be connected in parallel, so that the energy is recovered to the first and second capacitors for energy recovery through different paths. When the recovered energy is supplied to the PDP, the switching stabilization unit may allow the first and second capacitors for energy recovery to be connected in series, so that the energy is supplied to the PDP through one path.

The switching stabilization unit may include the second capacitor for energy recovery; two switches electrically connected in parallel with one terminal of the second capacitor for energy recovery; and a diode electrically connected between the other terminal of the second capacitor for energy recovery and one terminal of the first capacitor for energy recovery.

An anode of the diode of the switching stabilization unit may be connected to the one terminal of the first capacitor for energy recovery, and a cathode of the diode may be connected to the other terminal of the second capacitor for energy recovery, so that a path through which the energy is recovered to the second capacitor for energy recovery is formed.

The switching stabilization unit may further include a diode having a cathode connected to the energy recovery unit and an anode connected to a ground terminal; and a diode having an anode connected to the energy recovery unit and a cathode connected to a sustain discharge voltage terminal.

In accordance with another aspect of the present invention, there is provided an energy recovery circuit for a PDP, including: an energy recovery unit including a capacitor for energy recovery, recovering and storing energy and an inductor preventing a rapid increase of current, a control switch storing recovery energy and a control switch supplying discharge energy being connected in parallel between the capacitor and the inductor, and diodes for preventing reverse current being connected in series to the respective control switches; and a switching stabilization unit including an external input voltage source electrically connected to the energy recovery unit to supply an external voltage.

When recovered energy is supplied to the PDP, the capacitor for energy recovery and the external input voltage source may be connected in series, so that the energy is supplied to the PDP through one path Two switches may be connected in parallel between the capacitor for energy recovery and a ground voltage GND, and any one of the two switches may be electrically connected to the external input voltage source.

Any one of the two switches may further include a capacitor CR2 for charging an external voltage connected in parallel with the external input voltage source, and a diode D3 for preventing reverse current may be connected in series to the external input voltage source.

The external input voltage source and the capacitor CR2 for charging an external voltage may be connected in parallel between the control switch for supplying recovery energy and the ground voltage GND; the diode D3 for preventing reverse current may be connected in series between the external input voltage source and the control switch for supplying recovery energy; a first switch SW6 may be connected in series between the capacitor CR2 for charging an external voltage and the ground voltage GND; and a node between the capacitor CR2 for charging an external voltage and the first switch SW6, connected in series, may be connected through the control switch for storing recovery energy and a second switch SW5.

The external input voltage source may be a data voltage Vdata applied to a data electrode for address discharge.

Advantageous Effects

In accordance with an aspect of the present invention, an energy recovery circuit for a plasma display panel (PDP), a switching stabilization unit having one diode, two switches and one capacitor for energy recovery is additionally connected to the energy recovery circuit. Accordingly, energy recovered from a capacitor CP of a panel is divided and recovered to first and second capacitors CR1 and CR2 for energy recovery, connected in parallel. When the recovered energy is supplied again to the panel CP, a voltage of 2Vcr is supplied as an energy source to the first and second capacitors CR1 and CR2 connected in series through an LC resonant circuit formed by an auxiliary inductor LR and the capacitor CP of the panel.

In accordance with another aspect of the present invention, an energy recovery circuit for a PDP, two switches and an external input voltage source that is an external voltage supply are additionally connected to the conventional energy recovery circuit, so that a voltage corresponding to the sum of a voltage of a capacitor for energy recovery and a data voltage Vdata applied to a data electrode for address discharge is used as energy of a displacement current component supplied to the PDP. Accordingly, a voltage higher by the data voltage Vdata than that in the conventional energy recovery circuit is applied at the time when the displacement current is supplied to the PDP, so that a sustain discharge voltage Vsus can be applied to the panel after a sustain discharge pulse voltage rises up to the level of the sustain discharge voltage Vsus.

As a result, the difference of voltages applied to both drain and source terminals of a second switch SW2 is minimized at the time when the second switch SW2 is switched, so that switching can be stabilized by preventing hard switching from being generated when the sustain discharge voltage is applied to the panel. Further, switching and electro-magnetic interference (EMI) noises of the circuit, generated due to the hard switching can be decreased, and therefore, driving reliability of the circuit can be improved.

BRIEF DESCRIPTION OF THE DRAWINGS

The present invention will be more clearly understood from the following detailed description taken in conjunction with the accompanying drawings, in which.

MODE FOR THE INVENTION

Hereinafter, an energy recover circuit for a plasma display panel (PDP) according to embodiments of the present invention will be described in detail with reference to the accompanying drawings.

Figure 4:
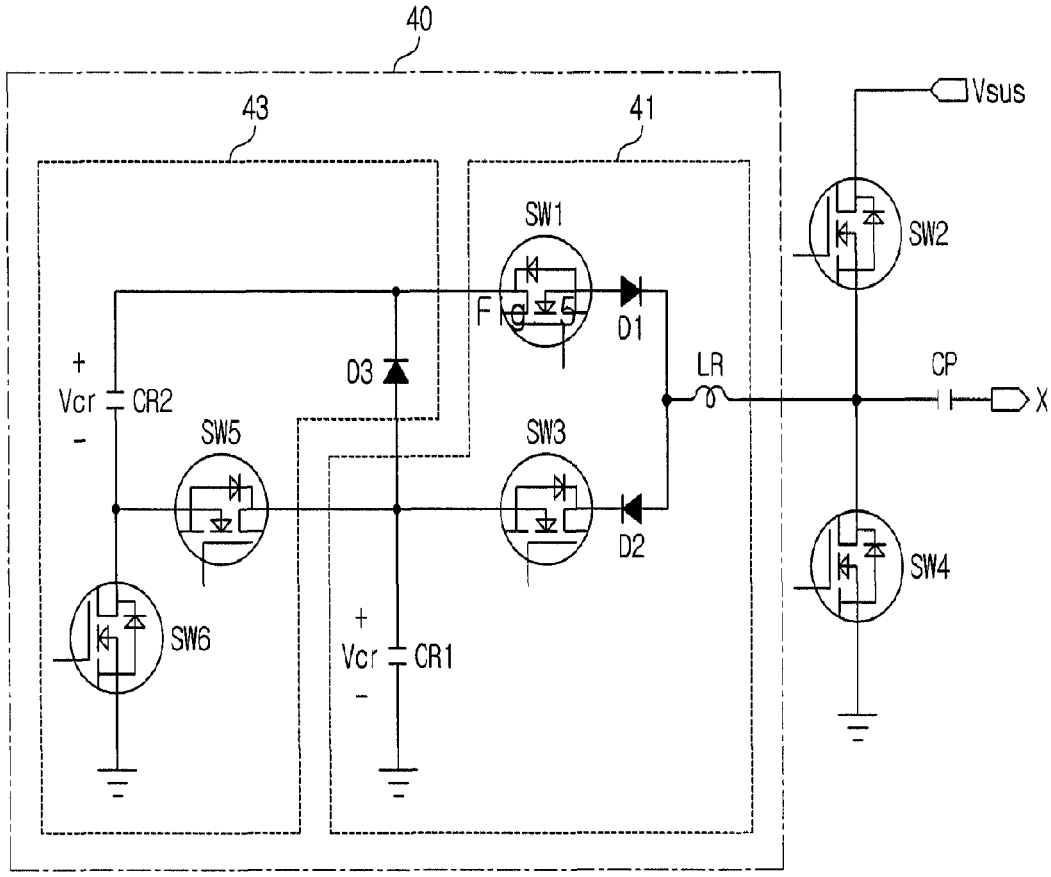
FIG. 4 is a circuit diagram of an energy recovery circuit for a PDP according to an embodiment of the present invention.
Figure 5:
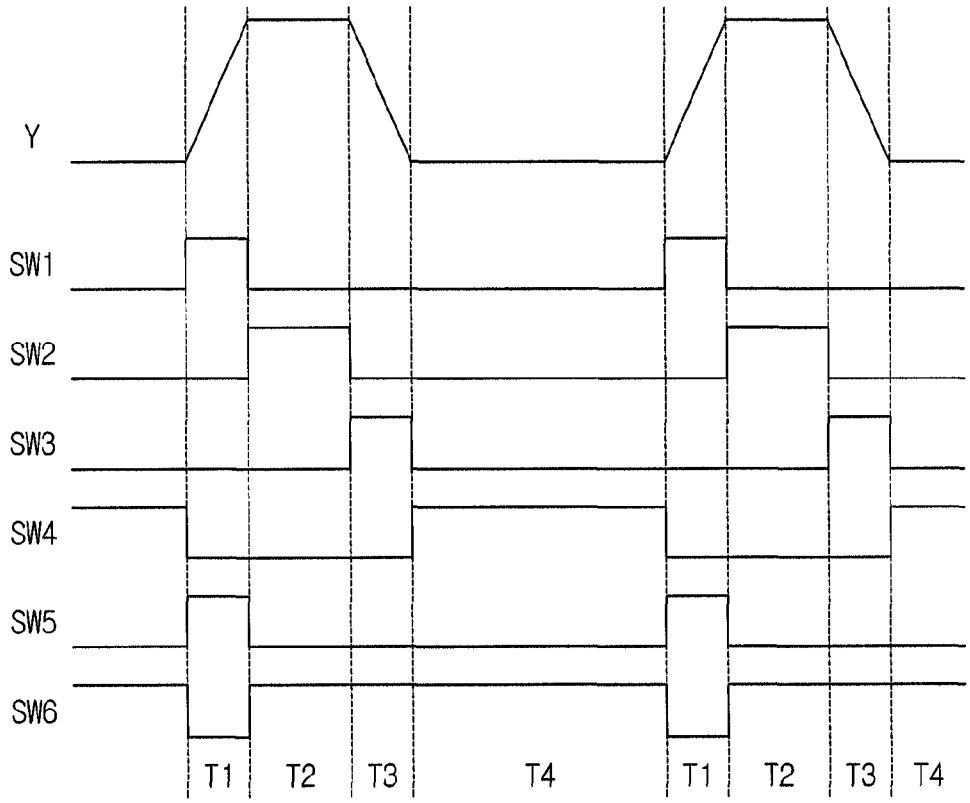
FIG. 5 is a timing diagram showing a sustain discharge voltage pulse and switch control signals, applied to the energy recovery circuit of FIG. 4.
Figure 6:
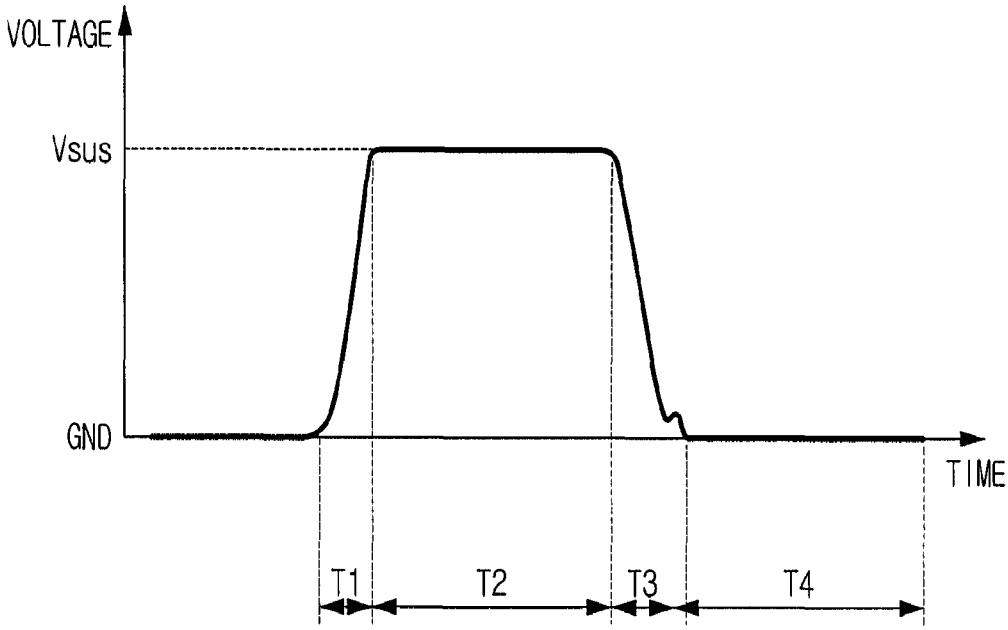
FIG. 6 is an actual waveform diagram showing a sustain discharge voltage pulse of the energy recovery circuit of FIG. 4.

FIG. 4 is a circuit diagram of an energy recovery circuit for a PDP according to an embodiment of the present invention. FIG. 5 is a timing diagram showing a sustain discharge voltage pulse and switch control signals, applied to the energy recovery circuit of FIG. 4. FIG. 6 is an actual waveform diagram showing a sustain discharge voltage pulse of the energy recovery circuit of FIG. 4.

Referring to FIG. 4, the energy recovery circuit 40 of the present invention includes an energy recovery unit 41 and a switching stabilization unit 43.

Figure 1:
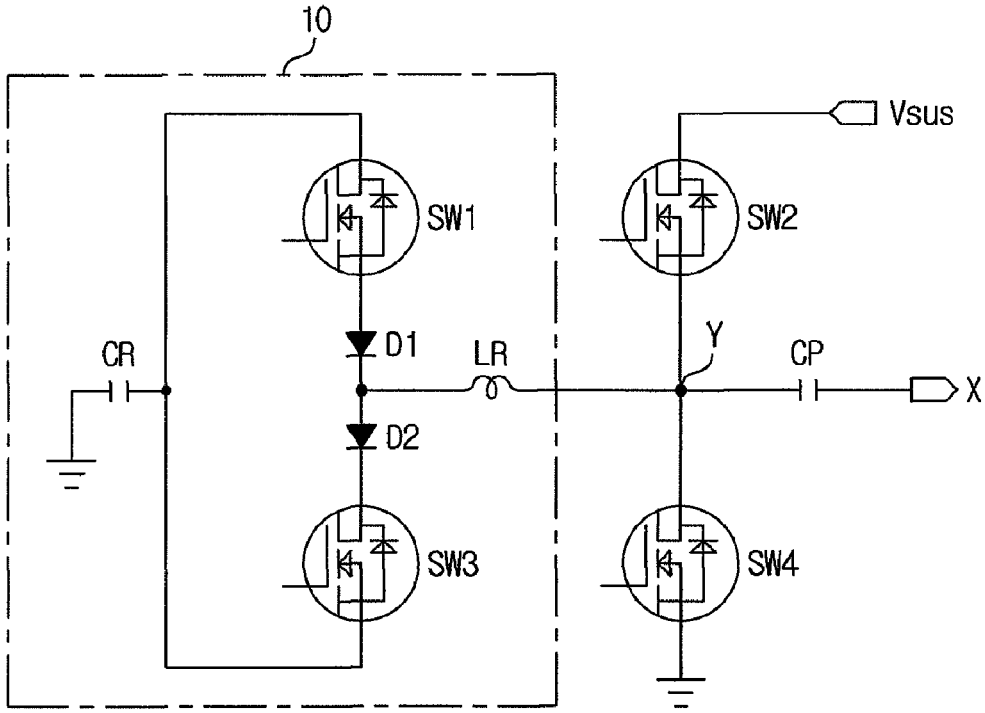
Fig. 1 (PRIOR ART)
FIG. 1 is a circuit diagram of a conventional energy recovery circuit for a plasma display panel (PDP)
Figure 2:
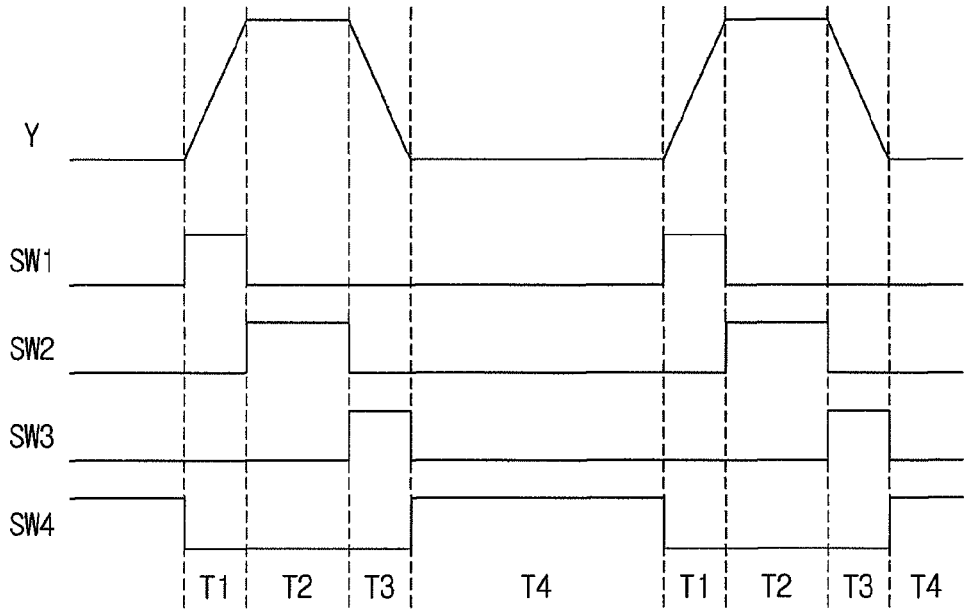
Fig. 2 (PRIOR ART)
FIG. 2 is a timing diagram showing a sustain discharge voltage pulse and switch control signals of the energy recovery circuit shown in FIG. 1.
Figure 3:
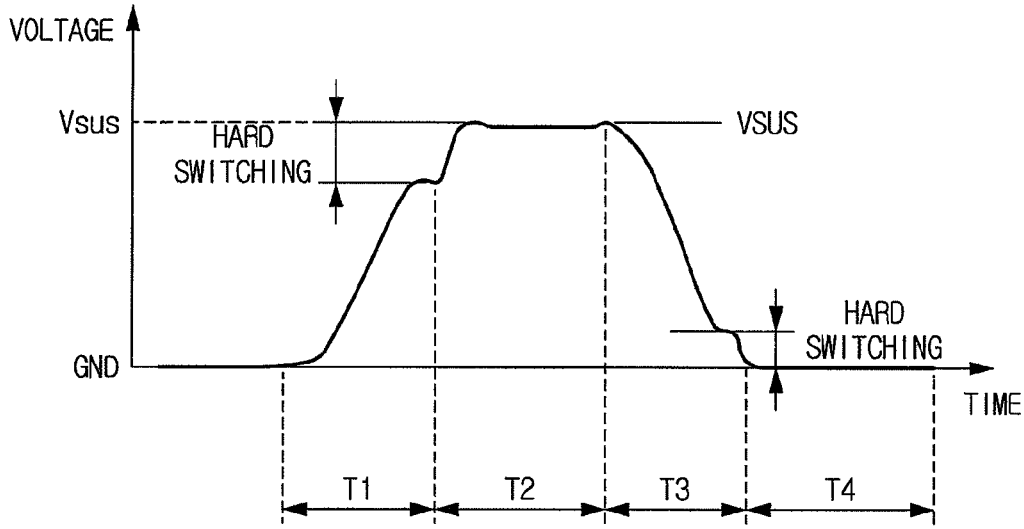
Fig. 3 (PRIOR ART)
FIG. 3 is an actual waveform diagram showing a sustain discharge voltage pulse of the energy recovery circuit shown in FIG. 1.

Here, the energy recovery unit 41 has the same structure as the energy recovery circuit 10 of FIG. 1. The switching stabilization unit 43 includes fifth and sixth switches SW5 and SW6, a third diode D3 and a second capacitor CR2 for energy recovery. The switching stabilization unit 43 is electrically connected between a first switch SW1 and a node between a first capacitor CR1 for energy recovery and a third switch SW3 of the energy recovery unit 41. That is, the node between the first capacitor CR1 for energy recovery and the third switch SW3 is grounded sequentially through the fifth and sixth switches SW5 and SW6, and is electrically connected to a node between the fifth and sixth switches SW5 and SW6 sequentially through the third diode D3 and the second capacitor CR2 for energy recovery. An anode of the third diode D3 is connected to the node between the first capacitor CR1 for energy recovery and the third switch SW3, and a cathode of the third diode D3 is connected to a node between the second capacitor CR2 for energy recovery and the first switch SW1.

Even when the order of the pair of the first switch SW1 and the first diode D1 is and the pair of the third switch SW3 and the second diode D2, which are connected in series, is changed, the operation of the energy recovery circuit 40 can be performed identically, as will be described later. The number of the respective switches, capacitors and diodes used in the energy recovery circuit 40 may be more than one depending on the current capacity or the like.

The operation of the energy recovery circuit 40 configured as described above will be described as divided into four periods T1 to T4 as shown in FIG. 5.

The first period T1 is a period in which the level of a sustain discharge pulse is shifted from the level of a ground voltage GND to the level of a sustain discharge voltage Vsus before the sustain discharge voltage Vsus is applied to a panel. In the first period T1, displacement current and a portion of discharge current are generated. First, it is assumed that a voltage Vcr is charged into the respective first and second capacitors CR1 and CR2 for energy recovery by recovering energy through a continuous operation of the energy recovery circuit in the fourth period T4. In the first period T1, the first and fifth switches SW1 and SW5 are turned on by first and fifth switch control signals of a high level, respectively, and the second, third, fourth and sixth switches SW2, SW3, SW4 and SW6 are turned off by second, third, fourth and sixth switch control signals of a low level, respectively. Accordingly, the first capacitor CR1 for energy recovery is electrically connected to a capacitor CP of the panel through the fifth switch SW5, the second capacitor CR2 for energy recovery, the first switch SW1, the first diode D1 and an auxiliary inductor LR. At this time, current is supplied to the capacitor CP of the panel by the LC resonance of the auxiliary inductor LR and the capacitor CP of the panel. The sustain discharge pulse voltage at node Y corresponding to one terminal of the capacitor CP of the panel is a voltage 2Vcr corresponding to the sum of a voltage Vcr charged into the first capacitor CR1 for energy recovery and a voltage Vcr charged into the second capacitor CR2 for energy recovery. Here, the voltage Vcr is a voltage ½ Vsus corresponding to ½ of the sustain discharge voltage Vsus. Theoretically, a voltage applicable to the node Y rises up to the maximum voltage 2Vsus that is two times higher than the voltage 2Vcr. Actually, however, the voltage does not rise up to the maximum voltage 2Vsus due to the resistance component of a circuit itself and the resistance component of a switch device itself. However, a voltage higher than the sustain discharge voltage Vsus can be applied to the node Y. Accordingly, ideal switching can be performed by controlling a switching control time depending on a time constant caused by the LC resonance.

The second period T2 is a period for continuously applying the sustain discharge voltage Vsus to the node Y, in which discharge current is supplied to the panel CP. In the second period T2, the second and sixth switches SW2 and SW6 are turned on by second and sixth switch signals of a high level, respectively, and the first, third, fourth and fifth switches SW1, SW3, SW4 and SW5 are turned off by first, third, fourth and fifth switch control signals of a low level, respectively. At this time, the sustain discharge voltage Vsus is directly supplied to the panel CP through the second switch SW2, and the required discharge current also flows into the panel CP through the second switch SW2. Therefore, the sustain discharge pulse voltage at the node Y is maintained continuously as the sustain discharge voltage Vsus during this period.

Meanwhile, the sixth switch SW6 is turned on so that one terminal of the second capacitor CR2 for energy recovery, i.e., a negative (−) terminal is fixed to a ground. The operation of the sixth switch SW6 is continuously performed in the subsequent periods T2, T3 and T4, except the first period T1.

The third period T3 is a period for recovering the energy supplied to the panel CP to the first and second capacitors CR1 and CR2 for energy recovery. Unlike when the voltage at the node Y rises, displacement current is generated when the panel CP operates as a current supply source. To this end, the third and sixth switches SW3 and SW6 are turned on by third and sixth switch control signals of a high level, respectively, and the first, second, fourth and fifth switches SW1, SW2, SW4 and SW5 are turned off by first, second, fourth and fifth switch control signals of a low level, respectively. Accordingly, current recovered to the panel CP is recovered to the capacitors for energy recovery through two paths. That is, the current flows into the first capacitor CR1 for energy recovery through the auxiliary inductor LR, the second diode D2 and the third switch SW3 from the panel CP, and flows into the second capacitor CR2 for energy recovery through the auxiliary inductor LR, the second diode D2, the third switch SW3 and the third diode D3 from the panel CP. Therefore, the sustain discharge pulse voltage at the node Y decreases from the sustain discharge voltage Vsus to the ground voltage GND.

In the energy recovery period T3, energies of the panel CP are recovered to the capacitors CR1 and CR2 for energy recovery through different current paths, respectively. In the energy supply period T1, energy of the capacitors for energy recovery is supplied to the panel through one current path. Accordingly, the energies respectively recovered to the first and second capacitors CR1 and CR2 for energy recovery has only a voltage decrement by the third diode D3.

The fourth period T4 is a period for applying the ground voltage GND to the panel CP. The fourth and sixth switches SW4 and SW6 are turned on by fourth and sixth switch control signals of a high level, respectively, and the first, second, third and fifth switches SW1, SW2, SW3 and SW5 are turned off by first, second, third and fifth switch control signals of a low level, respectively, thereby applying the ground voltage to the node Y through the fourth switch SW4. Therefore, the sustain discharge pulse voltage at the node Y is maintained continuously as the ground voltage GND.

At this time, the sustain discharge voltage Vsus is supplied through an electrode X, which is operated as described in the first, second and third periods T1, T2 and T3. Therefore, such switching operations are continuously performed until the respective periods for supplying the sustain discharge voltage to the electrode X are finished. Thereafter, these periods T1 to T4 are repeatedly performed as many times as the number of desired sustain discharge pulses.

Accordingly, when the energy recovery circuit 40 of the present invention performs switching operations as described above, the energy recovered from the panel CP is divided and recovered to the respective first and second capacitors CR1 and CR2 connected in parallel. When the recovered energy is supplied again to the panel CP, the voltage of 2Vcr is supplied as an energy source to the first and second capacitors CR1 and CR2 connected in series through an LC resonant circuit formed by the auxiliary inductor LR and the capacitor CP of the panel.

Typically, if the capacitor voltage Vcr is ½ Vsus, the capacitor voltage 2Vcr of the capacitors for energy recovery, supplied to the capacitor CP of the panel, is 2×½ Vsus, i.e., Vsus. That is, displacement current can be supplied to the capacitor CP of the panel by LC resonance of the auxiliary inductor LR and the capacitor CP of the panel, using a voltage of a capacitor for energy recovery having an energy source sufficiently higher than that in the conventional energy recovery circuit. Accordingly, a switching time for each of the periods is set appropriately, so that soft switching is possible.

In the energy recovery period T3, the two capacitors CR1 and CR2 for energy recovery are connected in parallel and operated by the original voltage Vcr of a capacitor for energy recovery, i.e., ½ Vsus. For this reason, resonance is possible at a low voltage by the auxiliary inductor LR and the capacitors CR1 and CR2 for energy recovery, like in the conventional energy recovery circuit.

Accordingly, in the first period T1 for supplying displacement current to the panel CP, the energy recovery circuit of the present invention supplies a higher voltage to the node Y of the panel with an energy source sufficiently higher than that in the conventional energy recovery circuit, so that the sustain discharge pulse voltage at the node Y is increased up to the sustain discharge voltage Vsus, and the sustain discharge voltage Vsus is then supplied to the panel through the second switch SW2. Therefore, at the time when the second switch SW2 is switched, the difference of voltages applied to both drain and source terminals of the second switch SW2 is minimized, so that switching can be stabilized. As shown in FIG. 6, it is possible to prevent hard switching of a sustain discharge pulse from being generated when the voltage at the node Y rises. As a result, switching and electro-magnetic interference (EMI) noises of the circuit, generated due to the hard switching, can be decreased, and driving reliability of the energy recovery circuit can be improved.

Figure 7:
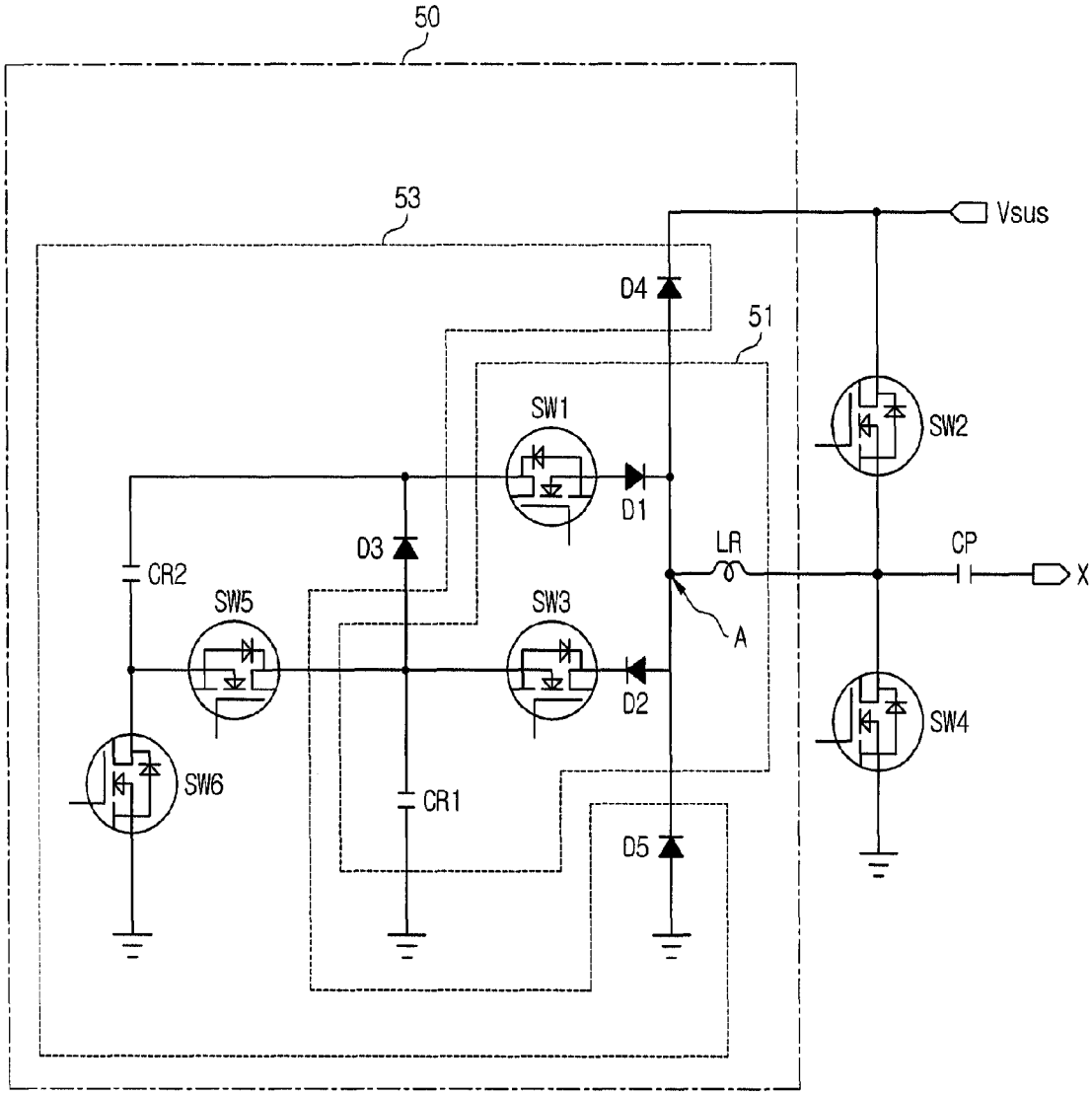
FIG. 7 is a circuit diagram of an energy recovery circuit for a PDP according to another embodiment of the present invention.

FIG. 7 is a circuit diagram of an energy recovery circuit for a PDP according to another embodiment of the present invention.

Referring to FIG. 7, the energy recovery circuit 50 of the present invention includes an energy recovery unit 51 and a switching stabilization unit 53.

Here, the energy recovery unit 51 has the same structure as the energy recovery unit 41 of FIG. 4.

The switching stabilization unit 53 has the same structure as the switching stabilization unit 43 of FIG. 4 except that fourth and fifth diodes D4 and D5 are additionally disposed. That is, an anode of the fourth diode D4 is connected to a cathode of a first diode D1 of the energy recovery unit 51, and a cathode of the fourth diode D4 is connected to a node between a second switch SW2 and a sustain discharge voltage source Vsus. A cathode of the fifth diode D5 is connected to an anode of a second diode D2, and an anode of the fifth diode D5 is connected to a ground.

In the energy recovery circuit configured as described above, an overshoot component generated at node A during an operation of a switching circuit causes heat generation and an EMI noise of the circuit. In order to prevent the overshoot component, when a voltage higher than the sustain discharge voltage Vsus is generated at the node A, current flows into the sustain discharge voltage source Vsus through the fourth unidirectional diode D4. When a voltage lower than a ground voltage GND is generated at the node A, current flows from the ground GND to the node A through the fifth unidirectional diode D5. Therefore, the voltage at the node A is maintained as a value between the ground voltage GND and the sustain discharge voltage Vsus.

Like the energy recovery circuit 40 of FIG. 4, the energy recovery circuit 50 can be operated in the same manner as the switch control timing diagram shown in FIG. 5. The operation of the energy recovery circuit 50 is almost identical to that of the energy recovery circuit 40. The operation of the energy recovery circuit 50 will be described as divided into four periods T1 to T4 with reference to FIG. 5.

The first period T1 is a period in which the level of a sustain discharge pulse is shifted from the level of the ground voltage GND to the level of a sustain discharge voltage Vsus before the sustain discharge voltage Vsus is applied to a panel. In the first period T1, displacement current and a portion of discharge current are generated. First, it is assumed that a voltage Vcr is charged into respective first and second capacitors CR1 and CR2 for energy recovery by recovering energy through a continuous operation of the energy recovery circuit in the fourth period T4. In the first period T1, first and fifth switches SW1 and SW5 are turned on by first and fifth switch control signals of a high level, respectively, and second, third, fourth and sixth switches SW2, SW3, SW4 and SW6 are turned off by second, third, fourth and sixth switch control signals of a low level, respectively. Accordingly, the first capacitor CR1 for energy recovery is electrically connected to a capacitor CP of the panel through the fifth switch SW5, the second capacitor CR2 for energy recovery, the first switch SW1, the first diode D1 and an auxiliary inductor LR. At this time, current is supplied to the panel CP by the LC resonance of the auxiliary inductor LR and the capacitor CP of the panel. The sustain discharge pulse voltage at node Y corresponding to one terminal of the capacitor CP of the panel is a voltage 2Vcr corresponding to the sum of a voltage Vcr charged into the first capacitor CR1 for energy recovery and a voltage Vcr charged into the second capacitor CR2 for energy recovery. Here, the voltage Vcr is a voltage ½ Vsus corresponding to ½ of the sustain discharge voltage Vsus. Theoretically, a voltage applicable to the node Y rises up to the maximum voltage 2Vsus that is two times higher than the voltage 2Vcr. Actually, however, the voltage does not rise up to the maximum voltage 2Vsus due to the resistance component of a circuit itself and the resistance component of a switch device itself. However, a voltage higher than the sustain discharge voltage Vsus can be applied to the node Y. Accordingly, ideal switching can be performed by controlling a switching control time depending on a time constant caused by the LC resonance.

Although the energy recovery circuit is designed to have the same circuits and electrical values and controlled by the timing diagram precisely controlled by the electrical values, the number of discharge cells of the panel may be different. In this case, the voltage waveforms at nodes Y and A may temporally exceed the sustain discharge voltage Vsus during the first period T1. This is because as the number of discharge cells is increased, the capacitance of the capacitor CP of the panel is increased, and therefore, the time constant caused by an LC resonant circuit in the energy recovery circuit is different. In the driving waveforms at the nodes Y and A, an overshoot may be generated, and heat may be generated from the circuit. For this reason, when the overshoot is generated, the fourth diode D4 is operated to prevent the circuit from operating at the sustain discharge voltage Vsus or higher.

The second period T2 is a period for continuously applying the sustain discharge voltage Vsus to the node Y, in which discharge current is supplied to the panel CP. In the second period T2, the second and sixth switches SW2 and SW6 are turned on by second and sixth switch signals of a high level, respectively, and the first, third, fourth and fifth switches SW1, SW3, SW4 and SW5 are turned off by first, third, fourth and fifth switch control signals of a low level, respectively. At this time, the sustain discharge voltage Vsus is directly supplied to the panel CP through the second switch SW2, and the required discharge current also flows into the panel CP through the second switch SW2. Therefore, the sustain discharge pulse voltage at the node Y is maintained continuously as the sustain discharge voltage Vsus during this period.

Meanwhile, the sixth switch SW6 is turned on so that one terminal of the second capacitor CR2 for energy recovery, i.e., a negative (−) terminal is fixed to a ground. The operation of the sixth switch SW6 is continuously performed in the subsequent periods T2, T3 and T4 except the first period T1.

The third period T3 is a period for recovering the energy supplied to the panel CP to the first and second capacitors CR1 and CR2 for energy recovery. Unlike when the voltage at the node Y rises, displacement current is generated when the capacitor CP of the panel operates as a current supply source. To this end, the third and sixth switches SW3 and SW6 are turned on by third and sixth switch control signals of a high level, respectively, and the first, second, fourth and fifth switches SW1, SW2, SW4 and SW5 are turned off by first, second, fourth and fifth switch control signals of a low level, respectively. Accordingly, current recovered to the panel CP is recovered to the capacitors for energy recovery through two paths. That is, the current flows into the first capacitor CR1 for energy recovery through the auxiliary inductor LR, the second diode D2 and the third switch SW3 from the capacitor CP of the panel, and flows into the second capacitor CR2 for energy recovery through the auxiliary inductor LR, the second diode D2, the third switch SW3 and the third diode D3 from the panel CP. Therefore, the sustain discharge pulse voltage at the node Y decreases from the sustain discharge voltage Vsus to the ground voltage GND.

At this time, the voltage at the node A may be lower than the ground voltage GND. In this case, the fifth diode D5 is operated to prevent the voltage at the node A from being lower than the ground voltage GND, so that it is possible to prevent an overshoot from being generated in the driving waveforms of the nodes Y and A and to prevent heat from being generated from the circuit.

In the energy recovery period T3, energies of the panel CP are recovered to the capacitors CR1 and CR2 for energy recovery through different current paths, respectively. In the energy supply period T1, energy of the capacitors for energy recovery is supplied to the panel through one current path. Accordingly, the energies respectively recovered to the first and second capacitors CR1 and CR2 for energy recovery have only a voltage decrement by the third diode D3.

The fourth period T4 is a period for applying the ground voltage GND to the capacitor CP of the panel. The fourth and sixth switches SW4 and SW6 are turned on by fourth and sixth switch control signals of a high level, respectively, and the first, second, third and fifth switches SW1, SW2, SW3 and SW5 are turned off by first, second, third and fifth switch control signals of a low level, respectively, thereby applying the ground voltage to the node Y through the fourth switch SW4. Therefore, the sustain discharge pulse voltage at the node Y is maintained continuously as the ground voltage GND.

At this time, the sustain discharge voltage Vsus is supplied through an electrode X, which is operated as described in the first, second and third periods T1, T2 and T3. Therefore, such switching operations are continuously performed until the respective periods for supplying the sustain discharge voltage to the electrode X are finished. Thereafter, these periods T1 to T4 are repeatedly performed as many times as the number of desired sustain discharge pulses.

Accordingly, when the energy recovery circuit 50 of the present invention performs switching operations as described above, the energy recovered from the capacitor CP of the panel is divided and recovered to the respective first and second capacitors CR1 and CR2 connected in parallel. When the recovered energy is supplied again to the panel CP, the voltage of 2Vcr is supplied as an energy source to the first and second capacitors CR1 and CR2 connected in series through an LC resonant circuit formed by the auxiliary inductor LR and the capacitor CP of the panel. Therefore, in the energy recovery circuit of the present invention, the difference of voltages applied to both drain and source terminals of the switch SW2 is minimized at the time when the second switch SW2 is switched, so that switching can be stabilized.

Figure 8:
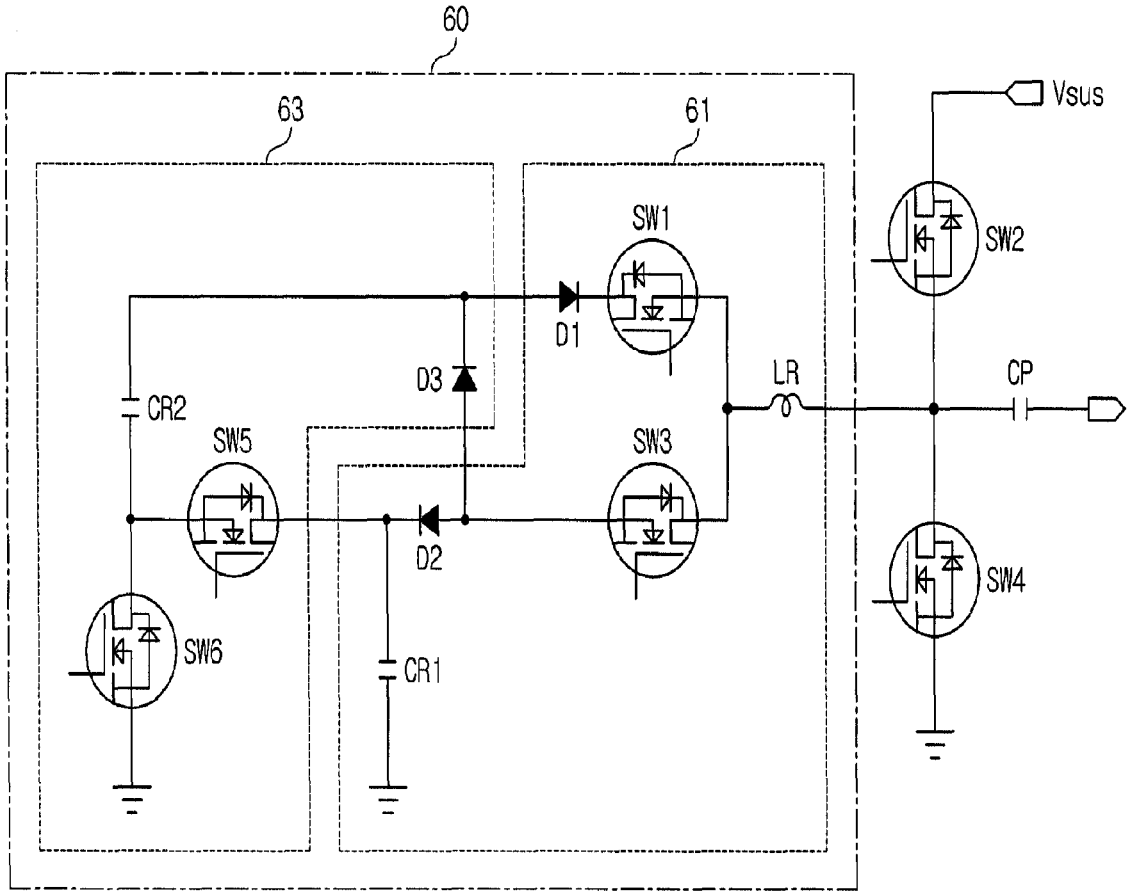
FIG. 8 is a circuit diagram of an energy recovery circuit for a PDP according to still another embodiment of the present invention.

FIG. 8 is a circuit diagram of an energy recovery circuit for a PDP according to still another embodiment of the present invention.

Referring to FIG. 8, the energy recovery circuit 60 of the present invention includes an energy recovery unit 61 and a switching stabilization unit 63.

Here, the energy recovery unit 61 has the same structure as the energy recovery unit 41 of FIG. 4, except that an anode of a second diode D2 is connected to a node between a third switch SW3 and a third diode D3, and a cathode of the second diode D2 is connected to a node between a fifth switch SW5 of the switching stabilization unit 63 and a first capacitor CR1 for energy recovery.

The switching stabilization unit 63 has the same structure as the switching stabilization unit 43 of FIG. 4.

The energy recovery circuit 60 configured as described above can be operated like the energy recovery circuit 40 of FIG. 4, except that only a path for recovering energy therethrough is partially changed in a third period T3. That is, energy recovered from a capacitor CP of a panel has a path formed in the order of an auxiliary inductor LR, the third switch SW3, the second diode D2 and the first capacitor CR1 for energy recovery, and a path formed in the order of the auxiliary inductor LR, the third switch SW3, the third diode D3, a second capacitor CR2 for energy recovery and a sixth switch SW6.

Like the energy recovery circuit 40 of FIG. 4, the energy recovery circuit 60 can be operated in the same manner as the switch control timing diagram shown in FIG. 5. The operation of the energy recovery circuit 60 is almost identical to that of the energy recovery circuit 40. The operation of the energy recovery circuit 60 will be described as divided into four periods T1 to T4 with reference to FIG. 5.

The first period T1 is a period in which the level of a sustain discharge pulse is shifted from the level of the ground voltage GND to the level of a sustain discharge voltage Vsus before the sustain discharge voltage Vsus is applied to a panel. In the first period T1, displacement current and a portion of discharge current are generated. First, it is assumed that a voltage Vcr is charged into respective first and second capacitors CR1 and CR2 for energy recovery by recovering energy through a continuous operation of the energy recovery circuit in the fourth period T4. In the first period T1, first and fifth switches SW1 and SW5 are turned on by first and fifth switch control signals of a high level, respectively, and second, third, fourth and sixth switches SW2, SW3, SW4 and SW6 are turned off by second, third, fourth and sixth switch control signals of a low level, respectively. Accordingly, the first capacitor CR1 for energy recovery is electrically connected to a capacitor CP of the panel through the fifth switch SW5, the second capacitor CR2 for energy recovery, the first switch SW1, the first diode D1 and an auxiliary inductor LR. At this time, current is supplied to the panel CP by the LC resonance of the auxiliary inductor LR and the capacitor CP of the panel. The sustain discharge pulse voltage at node Y corresponding to one terminal of the capacitor CP of the panel is a voltage 2Vcr corresponding to the sum of a voltage Vcr charged into the first capacitor CR1 for energy recovery and a voltage Vcr charged into the second capacitor CR2 for energy recovery. Theoretically, a voltage applicable to the node Y rises up to the maximum voltage 2Vsus that is two times higher than the voltage 2Vcr. Actually, however, the voltage does not rise up to the maximum voltage 2Vsus due to the resistance component of a circuit itself and the resistance component of a switch device itself. However, a voltage higher than the sustain discharge voltage Vsus can be applied to the node Y. Accordingly, ideal switching can be performed by controlling a switching control time depending on a time constant caused by the LC resonance.

At this time, the second and third diodes D2 and D3 prevent flow of reverse current.

The second period T2 is a period for continuously applying the sustain discharge voltage Vsus to the node Y, in which discharge current is supplied to the capacitor CP of the panel. In the second period T2, the second and sixth switches SW2 and SW6 are turned on by second and sixth switch signals of a high level, respectively, and the first, third, fourth and fifth switches SW1, SW3, SW4 and SW5 are turned off by first, third, fourth and fifth switch control signals of a low level, respectively. At this time, the sustain discharge voltage Vsus is directly supplied to the panel CP through the second switch SW2, and the required discharge current also flows into the panel CP through the second switch SW2. Therefore, the sustain discharge pulse voltage at the node Y is maintained continuously as the sustain discharge voltage Vsus during this period.

Meanwhile, the sixth switch SW6 is turned on so that one terminal of the second capacitor CR2 for energy recovery, i.e., a negative (−) terminal is fixed to a ground. The operation of the sixth switch SW6 is continuously performed in the subsequent periods T2, T3 and T4 except the first period T1.

The third period T3 is a period for recovering the energy supplied to the panel CP to the first and second capacitors CR1 and CR2 for energy recovery. Unlike when the voltage at the node Y rises, displacement current is generated when the capacitor CP of the panel operates as a current supply source. To this end, the third and sixth switches SW3 and SW6 are turned on by third and sixth switch control signals of a high level, respectively, and the first, second, fourth and fifth switches SW1, SW2, SW4 and SW5 are turned off by first, second, fourth and fifth switch control signals of a low level, respectively. Accordingly, current recovered to the panel CP is recovered to the capacitors for energy recovery through two paths. That is, the current flows into the first capacitor CR1 for energy recovery through the auxiliary inductor LR, the third switch SW3 and the second diode D2 from the capacitor CP of the panel, and flows into the sixth switch SW6 through the auxiliary inductor LR, the third switch SW3 and the third diode D3 and the second capacitor CR2 for energy recovery from the panel CP. Therefore, the sustain discharge pulse voltage at the node Y decreases from the sustain discharge voltage Vsus to the ground voltage GND.

In the energy recovery period T3, energies of the panel CP are recovered to the capacitors CR1 and CR2 for energy recovery through different current paths, respectively. In the energy supply period T1, energy of the capacitors for energy recovery is supplied to the panel through one current path.

The fourth period T4 is a period for applying the ground voltage GND to the capacitor CP of the panel. The fourth and sixth switches SW4 and SW6 are turned on by fourth and sixth switch control signals of a high level, respectively, and the first, second, third and fifth switches SW1, SW2, SW3 and SW5 are turned off by first, second, third and fifth switch control signals of a low level, respectively, thereby applying the ground voltage to the node Y through the fourth switch SW4. Therefore, the sustain discharge pulse voltage at the node Y is maintained continuously as the ground voltage GND.

At this time, the sustain discharge voltage Vsus is supplied through an electrode X, which is operated as described in the first, second and third periods T1, T2 and T3. Therefore, such switching operations are continuously performed until the respective periods for supplying the sustain discharge voltage to the electrode X are finished. Thereafter, these periods T1 to T4 are repeatedly performed as many times as the number of desired sustain discharge pulses.

Accordingly, when the energy recovery circuit 60 of the present invention performs switching operations as described above, the energy recovered from the capacitor CP of the panel is equally divided and recovered to the respective first and second capacitors CR1 and CR2 connected in parallel. When the recovered energy is supplied again to the panel CP, the voltage of 2Vcr is supplied as an energy source to the first and second capacitors CR1 and CR2 connected in series through an LC resonant circuit formed by the auxiliary inductor LR and the capacitor CP of the panel. Therefore, in the energy recovery circuit of the present invention, the difference of voltages applied to both drain and source terminals of the switch SW2 is minimized at the time when the second switch SW2 is switched, so that switching can be stabilized.

Figure 9:
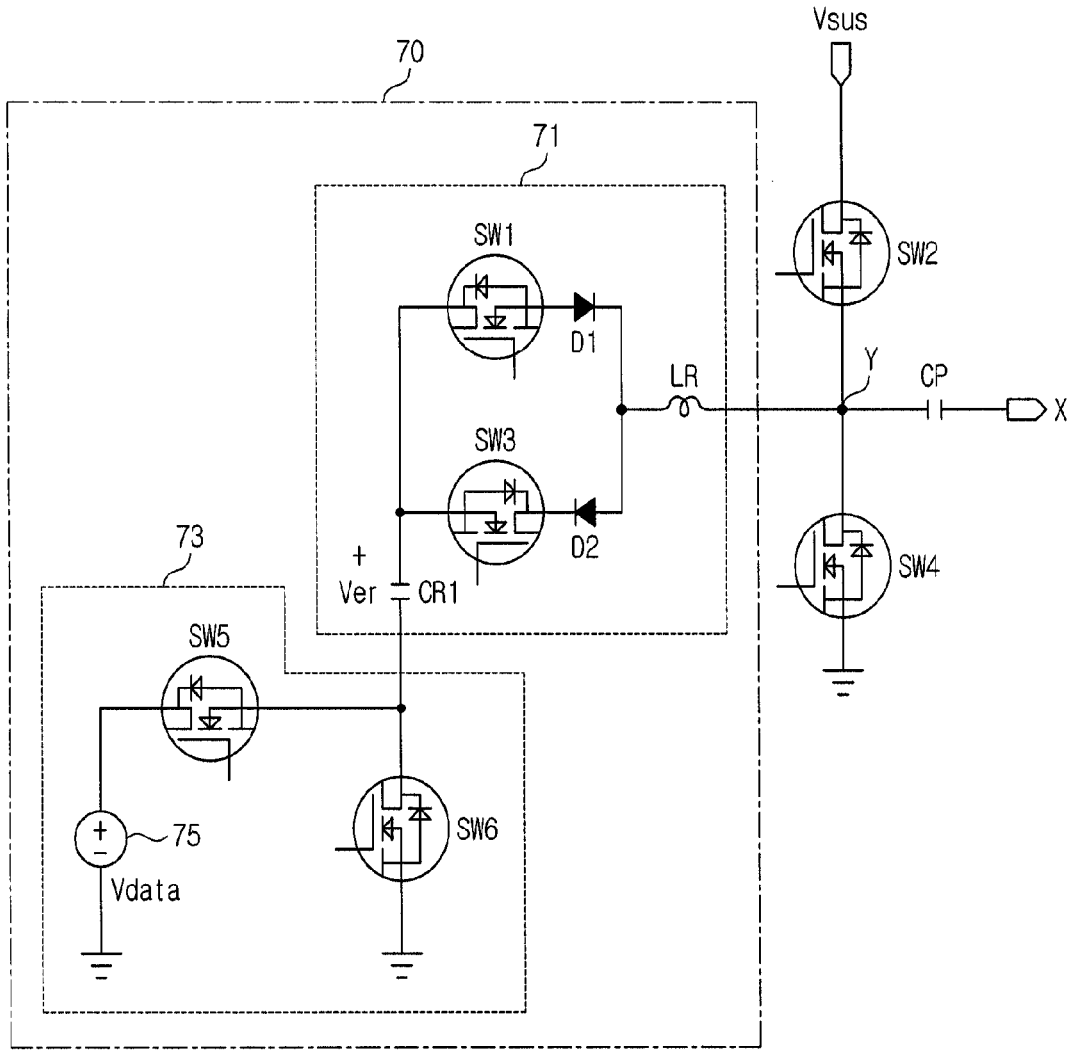
FIG. 9 is a circuit diagram of an energy recovery circuit for a PDP according to still another embodiment of the present invention.

FIG. 9 is a circuit diagram of an energy recovery circuit for a PDP according to still another embodiment of the present invention.

Referring to FIG. 9, the energy recovery circuit 70 of the present invention includes an energy recovery unit 71 and a switching stabilization unit 73.

Here, the energy recovery unit 71 has the same structure as the energy recovery circuit 10 of FIG. 1. The switching stabilization unit 73 includes fifth and sixth switches SW5 and SW6 and an external input voltage source 75, and is connected between a capacitor CR1 for energy recovery of the energy recovery unit 71 and a ground. That is, one terminal of the capacitor CR1 of the energy recovery unit 71 is grounded sequentially via the fifth switch SW5 and the external input voltage source 75 of the switching stabilization unit 73, and is grounded via the sixth switch SW6. For example, the external input voltage source 75 is an external voltage supply source that supplies an external voltage such as a data voltage Vdata applied to a data device in an address period. Since the data voltage Vdata is generally applied through a scan board Y and a sustain board X in a power module, a circuit is not added to supply the data voltage Vdata. It will be apparent that various voltage sources supplied to the PDP, such as a scan voltage Vscan and a sustain voltage Vsus, can be used as the external input voltage source. For convenience of illustration, it is described in the present invention that the data voltage Vdata is applied as an external input voltage source.

Like the energy recovery circuit 40 of FIG. 4, the energy recovery circuit 70 can be operated in the same manner as the switch control timing diagram shown in FIG. 5. The operation of the energy recovery circuit 70 is almost identical to that of the energy recovery circuit 40. The operation of the energy recovery circuit 70 will be described as divided into four periods T1 to T4 with reference to FIG. 5.

The first period T1 is a period in which the level of a sustain discharge pulse is shifted from the level of the ground voltage GND to the level of a sustain discharge voltage Vsus before the sustain discharge voltage Vsus is applied to a panel. In the first period T1, displacement current and a portion of discharge current are generated. First, it is assumed that a voltage Vcr is charged into the capacitor CR1 for energy recovery by recovering energy through a continuous operation of the energy recovery circuit in the fourth period T4. In the first period T1, first and fifth switches SW1 and SW5 are turned on by first and fifth switch control signals of a high level, respectively, and second, third, fourth and sixth switches SW2, SW3, SW4 and SW6 are turned off by second, third, fourth and sixth switch control signals of a low level, respectively. Accordingly, the external input voltage source 75 is electrically connected to a capacitor CP of the panel sequentially through the fifth switch SW5, the capacitor CR1 for energy recovery, the first switch SW1, a first diode D1 and an auxiliary inductor LR. At this time, current is supplied from the external input voltage source 75 to the capacitor CP of the panel by the LC resonance of the auxiliary inductor LR and the capacitor CP of the panel. The sustain discharge pulse voltage at node Y corresponding to one terminal of the capacitor CP of the panel is a voltage Vdata+Vcr corresponding to the sum of the data voltage of the external input voltage source 75 and the voltage Vcr charged into the capacitor CR1 for energy recovery. Here, the voltage Vcr is a voltage ½Vsus corresponding to ½ of the sustain discharge voltage Vsus. Theoretically, a voltage applicable to the node Y is a voltage 2Vdata+Vsus corresponding to two times of the voltage Vdata+Vcr. That is, when comparing with the conventional energy recovery circuit, a voltage higher by the voltage 2Vdata than the sustain discharge voltage Vsus can be applied. Actually, however, the voltage does not rise up to the voltage 2Vdata+Vsus due to the resistance component of a circuit itself and the resistance component of a switch device itself. However, ideal switching can be performed by controlling a switching control time depending on a time constant caused by the LC resonance.

The second period T2 is a period for continuously applying the sustain discharge voltage Vsus to the node Y, in which discharge current is supplied to the capacitor CP of the panel. In the second period T2, the second and sixth switches SW2 and SW6 are turned on by second and sixth switch signals of a high level, respectively, and the first, third, fourth and fifth switches SW1, SW3, SW4 and SW5 are turned off by first, third, fourth and fifth switch control signals of a low level, respectively. At this time, the sustain discharge voltage Vsus is directly supplied to the panel CP through the second switch SW2, and the required discharge current also flows into the panel CP through the second switch SW2. Therefore, the sustain discharge pulse voltage at the node Y is maintained continuously as the sustain discharge voltage Vsus during this period.

Meanwhile, the sixth switch SW6 is turned on so that one terminal of the capacitor CR1 for energy recovery, i.e., a negative (−) terminal is fixed to a ground. The operation of the sixth switch SW6 is continuously performed in the subsequent periods T2, T3 and T4 except the first period T1.

The third period T3 is a period for recovering the energy supplied to the panel CP to the first capacitor CR1 for energy recovery. Unlike when the voltage at the node Y rises, displacement current is generated when the capacitor CP of the panel operates as a current supply source. To this end, the third and sixth switches SW3 and SW6 are turned on by third and sixth switch control signals of a high level, respectively, and the first, second, fourth and fifth switches SW1, SW2, SW4 and SW5 are turned off by first, second, fourth and fifth switch control signals of a low level, respectively. Accordingly, current flows from the panel CP to the capacitor CR1 for energy recovery through the auxiliary inductor LR, the second diode D2 and the third switch SW3, so that the energy of the panel CP is recovered to the capacitor CR1 for energy recovery. Therefore, the sustain discharge pulse voltage at the node Y decreases from the sustain discharge voltage Vsus to the ground voltage GND.

The fourth period T4 is a period for applying the ground voltage GND to the capacitor CP of the panel. The fourth and sixth switches SW4 and SW6 are turned on by fourth and sixth switch control signals of a high level, respectively, and the first, second, third and fifth switches SW1, SW2, SW3 and SW5 are turned off by first, second, third and fifth switch control signals of a low level, respectively, thereby applying the ground voltage to the node Y through the fourth switch SW4. Therefore, the sustain discharge pulse voltage at the node Y is maintained continuously as the ground voltage GND.

At this time, the sustain discharge voltage Vsus is supplied through an electrode X, which is operated as described in the first, second and third periods T1, T2 and T3. Therefore, such switching operations are continuously performed until the respective periods for supplying the sustain discharge voltage to the electrode X are finished. Thereafter, these periods T1 to T4 are repeatedly performed as many times as the number of desired sustain discharge pulses.

When the energy recovery circuit 70 of the present invention performs switching operations as described above, the energy recovered from the panel CP is stored in the capacitor CR1 for energy recovery. When the stored energy is supplied to the panel CP, the capacitor CR1 for energy recovery is connected in series to the external input voltage source, so that the sustain discharge voltage Vsus is applied to the node Y through the second switch SW2 in the state that the voltage at the node Y is higher than that in the conventional energy recovery circuit. Accordingly, it is possible to prevent hard switching from being generated when the sustain discharge pulse voltage at the node Y rises, so that switching can be stabilized.

Accordingly, since the energy recovery circuit of the present invention has a sufficiently high energy source, a higher voltage is supplied to the node Y of the panel as compared with the conventional energy recovery circuit, so that the sustain discharge pulse voltage at the node Y is increased up to the sustain discharge voltage Vsus, and the sustain discharge voltage Vsus is then supplied to the panel through the second switch SW2. Therefore, at the time when the second switch SW2 is switched, the difference of voltages applied to both drain and source terminals of the second switch SW2 is minimized, so that switching can be stabilized. As shown in FIG. 6, it is possible to prevent hard switching of a sustain discharge pulse from being generated when the voltage at the node Y rises. As a result, switching and EMI noises of the circuit, generated due to the hard switching, can be decreased, and driving reliability of the energy recovery circuit can be improved.

Figure 10:
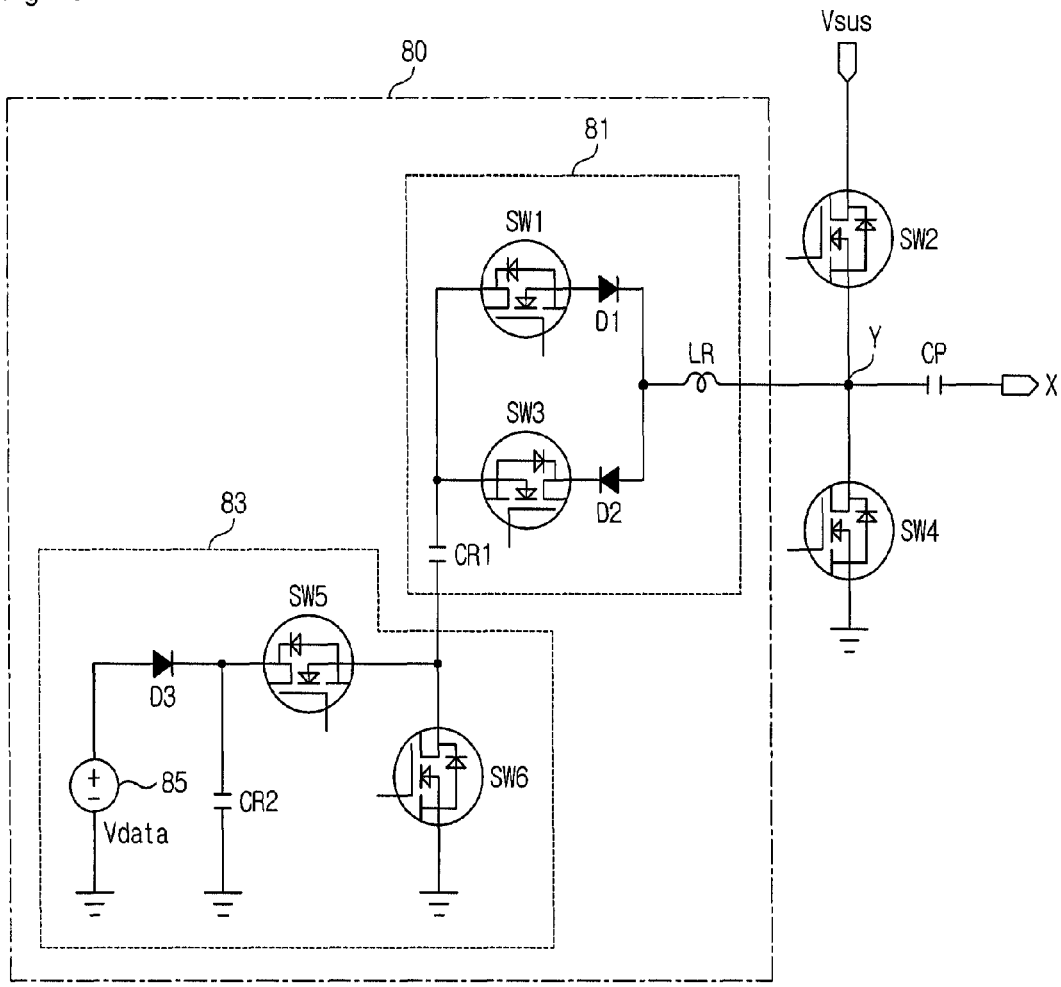
FIG. 10 is a circuit diagram of an energy recovery circuit for a PDP according to still another embodiment of the present invention.

FIG. 10 is a circuit diagram of an energy recovery circuit for a PDP according to still another embodiment of the present invention.

Referring to FIG. 10, the energy recovery circuit 80 of the present invention includes an energy recovery unit 81 and a switching stabilization unit 83.

Here, the energy recovery unit 81 has a structure similar to the energy recovery unit 71 of FIG. 9. The energy recovery unit 81 is different from the energy recovery unit 71 of FIG. 9 in that a negative (−) terminal of a capacitor CR1 for energy recovery is connected to a middle node between fifth and sixth switches SW5 and SW6 of the switching stabilization unit 83.

The switching stabilization unit 83 has the same structure as the switching stabilization unit 73 of FIG. 9, except that a third diode D3 and a capacitor CR2 are additionally disposed between the fifth switch SW5 and an external input voltage source 85. That is, a node between a cathode of the third diode D3 and the fifth switch SW5 is grounded through the capacitor CR2, and an anode of the third diode D3 is connected to the external input voltage source 85. For example, the external input voltage source 85 is an external voltage supply that supplies an external voltage such as a data voltage Vdata applied to a data device in an address period.

In the energy recovery circuit 80 configured as described above, the data voltage Vdata of the external input voltage source 85 is not directly connected to a switch device, but a voltage indirectly charged using the capacitor CR2 is used at the time when a high voltage is applied to node Y. The charging of the capacitor CR2 is continuously performed in the entire periods T1 to T4 of a sustain discharge pulse voltage as shown in FIG. 5.

Like the energy recovery circuit 70 of FIG. 9, the energy recovery circuit 80 can be operated in the same manner as the switch control timing diagram shown in FIG. 5. The operation of the energy recovery circuit 80 is almost identical to that of the energy recovery circuit 70. The operation of the energy recovery circuit 80 will be described as divided into four periods T1 to T4 with reference to FIG. 5.

The first period T1 is a period in which the level of a sustain discharge pulse is shifted from the level of the ground voltage GND to the level of a sustain discharge voltage Vsus before the sustain discharge voltage Vsus is applied to a panel. First, it is assumed that a voltage Vcr is charged into the capacitor CR1 for energy recovery by recovering energy through a continuous operation of the energy recovery circuit in the fourth period T4, and a data voltage Vdata is charged into the capacitor CR2 for charging a data voltage. In the first period T1, first and fifth switches SW1 and SW5 are turned on by first and fifth switch control signals of a high level, respectively, and second, third, fourth and sixth switches SW2, SW3, SW4 and SW6 are turned off by second, third, fourth and sixth switch control signals of a low level, respectively. Accordingly, the data voltage Vdata charged into the capacitor CR2 for charging a data voltage and the voltage Vcr charged into the capacitor CR1 for energy recovery by the external input voltage source 85 are electrically connected to a capacitor CP of the panel sequentially through the capacitor CR2 for charging a data voltage, the fifth switch SW5, the capacitor CR1 for energy recovery, the first switch SW1, a first diode D1 and an auxiliary inductor LR. At this time, current is supplied from the capacitor CR2 for charging a data voltage and the capacitor CR1 for energy recovery to the capacitor CP of the panel by the LC resonance of the auxiliary inductor LR and the capacitor CP of the panel. The sustain discharge pulse voltage at node Y corresponding to one terminal of the capacitor CP of the panel is a voltage Vdata+Vcr corresponding to the sum of the voltage Vdata of the capacitor CR2 for charging a data voltage and the voltage Vcr charged into the capacitor CR1 for energy recovery. Here, the voltage Vcr is a voltage ½ Vsus corresponding to ½ of the sustain discharge voltage Vsus. Theoretically, a voltage applicable to the node Y is a voltage 2Vdata+Vsus corresponding to two times of the voltage Vdata+Vcr. That is, when comparing with the conventional energy recovery circuit, a voltage higher by the voltage 2Vdata than the sustain discharge voltage Vsus can be applied. Actually, however, the voltage does not rise up to the voltage 2Vdata+Vsus due to the resistance component of a circuit itself and the resistance component of a switch device itself. However, ideal switching can be performed by controlling a switching control time depending on a time constant caused by the LC resonance.

The second period T2 is a period for continuously applying the sustain discharge voltage Vsus to the node Y, in which discharge current is supplied to the capacitor CP of the panel. In the second period T2, the second and sixth switches SW2 and SW6 are turned on by second and sixth switch signals of a high level, respectively, and the first, third, fourth and fifth switches SW1, SW3, SW4 and SW5 are turned off by first, third, fourth and fifth switch control signals of a low level, respectively. At this time, the sustain discharge voltage Vsus is directly supplied to the panel CP through the second switch SW2, and the required discharge current also flows into the panel CP through the second switch SW2. Therefore, the sustain discharge pulse voltage at the node Y is maintained continuously as the sustain discharge voltage Vsus during this period.

Meanwhile, the sixth switch SW6 is turned on so that one terminal of the capacitor CR1 for energy recovery, i.e., a negative (−) terminal is fixed to a ground. The operation of the sixth switch SW6 is continuously performed in the subsequent periods T2, T3 and T4 except the first period T1.

The third period T3 is a period for recovering the energy supplied to the panel CP to the first capacitor CR1 for energy recovery. Unlike when the voltage at the node Y rises, displacement current is generated when the capacitor CP of the panel operates as a current supply source. To this end, the third and sixth switches SW3 and SW6 are turned on by third and sixth switch control signals of a high level, respectively, and the first, second, fourth and fifth switches SW1, SW2, SW4 and SW5 are turned off by first, second, fourth and fifth switch control signals of a low level, respectively. In the circuit, the panel CP is electrically connected to the auxiliary inductor LR, the second diode D2, the third switch SW3, the capacitor CR1 for energy recovery and the sixth switch SW6. Accordingly, current flows from the panel CP to the capacitor CR1 for energy recovery through the auxiliary inductor LR, the second diode D2 and the third switch SW3, so that the energy of the panel CP is recovered to the capacitor CR1 for energy recovery. Therefore, the sustain discharge pulse voltage at the node Y decreases from the sustain discharge voltage Vsus to the ground voltage GND.

The fourth period T4 is a period for applying the ground voltage GND to the capacitor CP of the panel. The fourth and sixth switches SW4 and SW6 are turned on by fourth and sixth switch control signals of a high level, respectively, and the first, second, third and fifth switches SW1, SW2, SW3 and SW5 are turned off by first, second, third and fifth switch control signals of a low level, respectively, thereby applying the ground voltage to the node Y through the fourth switch SW4. Therefore, the sustain discharge pulse voltage at the node Y is maintained continuously as the ground voltage GND.

At this time, the sustain discharge voltage Vsus is supplied through an electrode X, which is operated as described in the first, second and third periods T1, T2 and T3. Therefore, such switching operations are continuously performed until the respective periods for supplying the sustain discharge voltage to the electrode X are finished. Thereafter, these periods T1 to T4 are repeatedly performed as many times as the number of desired sustain discharge pulses.

Accordingly, the energy recovered from the panel CP is stored in the capacitor CR1 for energy recovery. When the stored energy is supplied to the panel CP, the capacitor CR1 for energy recovery is connected in series to the external input voltage source, so that the sustain discharge voltage Vsus is applied to the node Y through the second switch SW2 in the state that the voltage at the node Y is higher than that in the conventional energy recovery circuit. Accordingly, it is possible to prevent hard switching from being generated when the sustain discharge pulse voltage at the node Y rises, so that switching can be stabilized.

Figure 11:
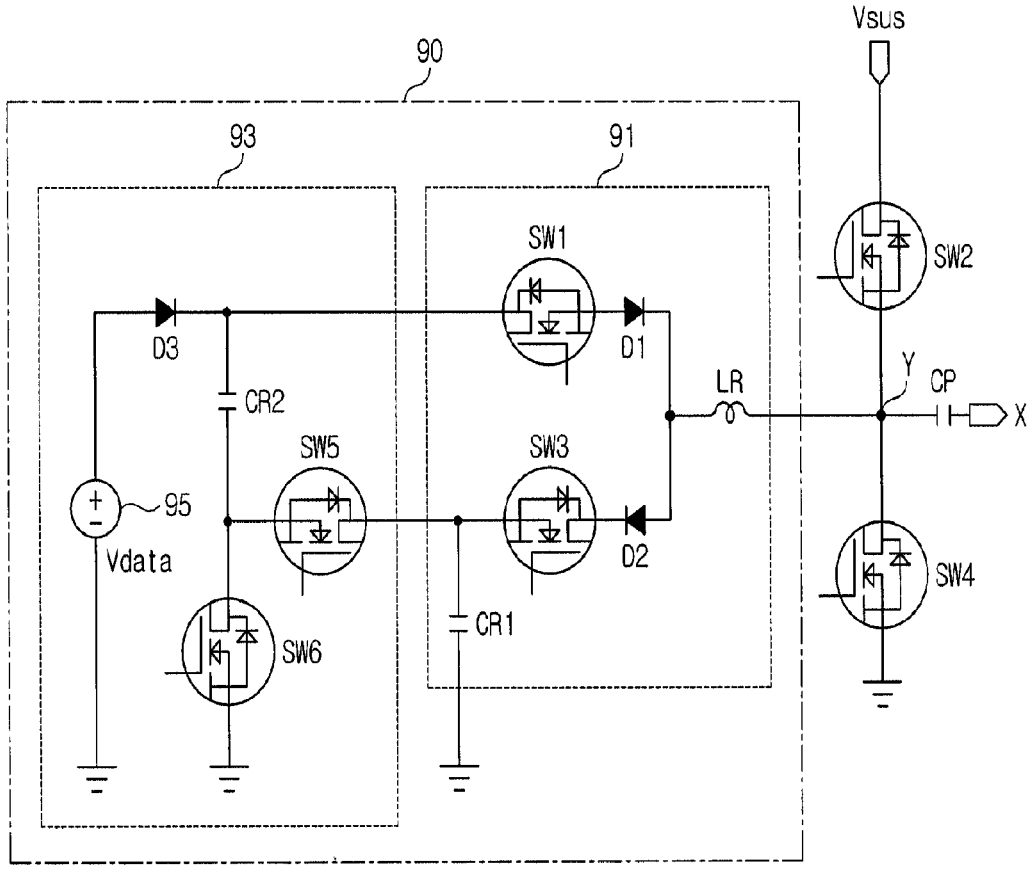
FIG. 11 is a circuit diagram of an energy recovery circuit for a PDP according to still another embodiment of the present invention.

FIG. 11 is a circuit diagram of an energy recovery circuit for a PDP according to still another embodiment of the present invention.

Referring to FIG. 11, the energy recovery circuit 90 of the present invention includes an energy recovery unit 91 and a switching stabilization unit 93.

The energy recovery unit 91 has a structure similar to the energy recovery unit 71 of FIG. 9. However, the energy recovery unit 91 is different from the energy recovery unit 71 in that a drain terminal of a first switch SW1 is connected to a node between a capacitor CR2 for charging a data voltage of the switching stabilization unit 93 and a third diode D3, and a middle node between a capacitor CR1 for energy recovery and a third switch SW3 is connected to a source terminal of a fifth switch SW5 of the switching stabilization unit 93.

In the switching stabilization unit 93, the fifth switch SW5 and a sixth switch SW6 are sequentially connected from the middle node between the third switch SW3 and the capacitor CR1 for energy recovery to a ground. The capacitor CR2 is connected to the node between a cathode of the third diode D3 and the first switch SW of the energy recovery unit 91 and the node between the fifth and sixth switches SW5 and SW6. An external input voltage source 95 is connected between an anode of the third diode D3 and the ground. The external input voltage source 95 is an external voltage supply that supplies an external voltage such as a data voltage Vdata applied to a data device in an address period. The capacitor CR1 operates as a capacitor for energy recovery, which allows energy supplied to the panel CP to be recovered and charged, and the capacitor CR2 allows the data voltage Vdata of the external input voltage source 95 to be charged, thereby increasing the energy supplied to the panel CP.

That is, in the energy recovery circuit 90, the positions of the capacitor CR1 recovering energy supplied to the panel CP and the capacitor CR2 storing energy supplied from the external input voltage source 95 are different from those in the energy recovery circuit 80 of FIG. 10. Therefore, the data voltage of the external input voltage source 95 is indirectly supplied to the panel using the capacitor CR2.

The operation of the energy recovery circuit 90 configured as described above will be described as divided into four periods T1 to T4.

First, it is assumed that a voltage Vcr1 that is ½ of the sustain discharge voltage is charged into the capacitor CR1 for energy recovery and the data voltage Vdata is charged into the capacitor CR2 for charging a data voltage through a continuous switching operations.

In the first period T1, first and fifth switches SW1 and SW5 are turned on by first and fifth switch control signals of a high level, respectively, and second, third, fourth and sixth switches SW2, SW3, SW4 and SW6 are turned off by second, third, fourth and sixth switch control signals of a low level, respectively.

At this time, displacement current is supplied from the capacitor CR1 for energy recovery to the panel CP through the fifth switch SW5, the capacitor CR2 for charging a data voltage, the first switch SW1, a first diode D1, an inductor LR. The voltage at node Y is a voltage Vdata+Vcr1 corresponding to the sum of the voltage Vcr1 charged into the capacitor CR1 for energy recovery and the data voltage Vdata of the external input voltage source 95, charged into the capacitor CR2 for charging a data voltage. Here, the voltage Vcr1 is a voltage ½ Vsus corresponding to ½ of the sustain discharge voltage Vsus. Theoretically, a voltage applicable to the node Y is a voltage 2Vdata+Vsus corresponding to two times of the voltage Vdata+Vcr1. That is, when comparing with the conventional energy recovery circuit, a voltage higher by the voltage 2Vdata than the sustain discharge voltage Vsus can be applied. Actually, however, the voltage does not rise up to the voltage 2Vdata+Vsus due to the resistance component of a circuit itself and the resistance component of a switch device itself. However, ideal switching can be performed by controlling a switching control time depending on a time constant caused by the LC resonance.

In the second period T2, the second and sixth switches SW2 and SW6 are turned on by second and sixth switch signals of a high level, respectively, and the first, third, fourth and fifth switches SW1, SW3, SW4 and SW5 are turned off by first, third, fourth and fifth switch control signals of a low level, respectively. At this time, the sustain discharge voltage Vsus is directly supplied to the panel CP through the second switch SW2, and the required discharge current also flows into the panel CP through the second switch SW2. Therefore, the sustain discharge pulse voltage at the node Y is maintained continuously as the sustain discharge voltage Vsus during this period.

Since the sixth switch SW6 is turned on, energy is charged into the capacitor CR2 for charging a data voltage from the external input voltage source 95. The operation of the sixth switch SW6 is continuously performed in the subsequent periods T2, T3 and T4 except the first period T1.

The third period T3 is a period for recovering the energy supplied to the panel CP to the first capacitor CR1 for energy recovery. Unlike when the voltage at the node Y rises, displacement current is generated when the capacitor CP of the panel operates as a current supply source. To this end, the third and sixth switches SW3 and SW6 are turned on by third and sixth switch control signals of a high level, respectively, and the first, second, fourth and fifth switches SW1, SW2, SW4 and SW5 are turned off by first, second, fourth and fifth switch control signals of a low level, respectively. Accordingly, current flows from the panel CP to the capacitor CR1 for energy recovery through the auxiliary inductor LR, the second diode D2 and the third switch SW3, so that the energy of the panel is recovered to the capacitor CR1 for energy recovery. Therefore, the sustain discharge pulse voltage at the node Y decreases from the sustain discharge voltage Vsus to the ground voltage GND.

The fourth period T4 is a period for applying the ground voltage GND to the capacitor CP of the panel. The fourth and sixth switches SW4 and SW6 are turned on by fourth and sixth switch control signals of a high level, respectively, and the first, second, third and fifth switches SW1, SW2, SW3 and SW5 are turned off by first, second, third and fifth switch control signals of a low level, respectively, thereby applying the ground voltage to the node Y through the fourth switch SW4. Therefore, the sustain discharge pulse voltage at the node Y is maintained continuously as the ground voltage GND.

At this time, the sustain discharge voltage Vsus is applied from an electrode X corresponding to the opposite side of the panel, thereby completing one sustain discharge period.

Meanwhile, a power source differently formed in a board for supplying a sustain electrode (X) or scan electrode (Y) waveform may be connected instead of the data voltage Vdata.

Accordingly, the energy recovered from the capacitor CP of the panel is stored in the capacitor CR1 for energy recovery. When the stored energy is supplied to the panel CP, the capacitor CR1 for energy recovery is connected in series to the external input voltage source, so that the sustain discharge voltage Vsus is applied to the node Y through the second switch SW2 in the state that the voltage at the node Y is higher than that in the conventional energy recovery circuit. Accordingly, it is possible to prevent hard switching from being generated when the sustain discharge pulse voltage at the node Y rises, so that switching can be stabilized.

The invention has been described in detail with reference to example embodiments thereof. However, it will be appreciated by those skilled in the art that changes may be made in these embodiments without departing from the principles and spirit of the invention, the scope of which is defined in the accompanying claims and their equivalents.

Industrial Applicability

In accordance with an aspect of the present invention, an energy recovery circuit for a plasma display panel (PDP), a switching stabilization unit having one diode, two switches and one capacitor for energy recovery is additionally connected to the conventional energy recovery circuit. Accordingly, energy recovered from a capacitor CP of a panel is divided and recovered to first and second capacitors CR1 and CR2 for energy recovery, connected in parallel. When the recovered energy is supplied again to the panel CP, a voltage of 2Vcr is supplied as an energy source to the first and second capacitors CR1 and CR2 connected in series through an LC resonant circuit formed by an auxiliary inductor LR and the capacitor CP of the panel.

In accordance with another aspect of the present invention, an energy recovery circuit for a PDP, two switches and an external input voltage source that is an external voltage supply are additionally connected to the conventional energy recovery circuit, so that a voltage corresponding to the sum of a voltage of a capacitor for energy recovery and a data voltage Vdata applied to a data electrode for address discharge is used as energy of a displacement current component supplied to the PDP. Accordingly, a voltage higher by the data voltage Vdata than that in the conventional energy recovery circuit is applied at the time when the displacement current is supplied to the PDP, so that a sustain discharge voltage Vsus can be applied to the panel after a sustain discharge pulse voltage rises up to the level of the sustain discharge voltage Vsus.

As a result, the difference of voltages applied to both drain and source terminals of a second switch SW2 is minimized at the time when the second switch SW2 is switched, so that switching can be stabilized by preventing hard switching from being generated when the sustain discharge voltage is applied to the panel. Further, switching and electro-magnetic interference (EMI) noises of the circuit, generated due to the hard switching can be decreased, and therefore, driving reliability of the circuit can be improved.

The invention claimed is:

1. An energy recovery circuit for a plasma display panel (PDP), comprising:

an energy recovery unit recovering and storing energy from the PDP; and a switching stabilizing unit electrically connected to the energy recovery unit to stabilize switching of a sustain discharge pulse applied to the PDP, wherein, when energy is recovered from the PDP, the switching stabilization unit allows a first capacitor for energy recovery of the energy recovery unit and a second capacitor for energy recovery of the switching stabilization unit to be connected in parallel, so that the energy is recovered to the first and second capacitors for energy recovery through different paths; and when the recovered energy is supplied to the PDP, the switching stabilization unit allows the first and second capacitors for energy recovery to be connected in series, so that the energy is supplied to the PDP through one path.

2. The energy recovery circuit as set forth in claim 1, wherein the switching stabilization unit comprises:

the second capacitor for energy recovery; two switches electrically connected in parallel with one terminal of the second capacitor for energy recovery; and a diode electrically connected between the other terminal of the second capacitor for energy recovery and one terminal of the first capacitor for energy recovery.

3. The energy recovery circuit as set forth in claim 2, wherein an anode of the diode of the switching stabilization unit is connected to the one terminal of the first capacitor for energy recovery, and a cathode of the diode is connected to the other terminal of the second capacitor for energy recovery, so that a path through which the energy is recovered to the second capacitor for energy recovery is formed.

4. The energy recovery circuit as set forth in claim 3, wherein the switching stabilization unit further comprises:

a diode having a cathode connected to the energy recovery unit and an anode connected to a ground terminal; and a diode having an anode connected to the energy recovery unit and a cathode connected to a sustain discharge voltage terminal.

5. The energy recovery circuit as set forth in claim 2, wherein the switching stabilization unit further comprises:

a diode having a cathode connected to the energy recovery unit and an anode connected to a ground terminal; and a diode having an anode connected to the energy recovery unit and a cathode connected to a sustain discharge voltage terminal.

6. The energy recovery circuit as set forth in claim 1, wherein the switching stabilization unit further comprises:

a diode having a cathode connected to the energy recovery unit and an anode connected to a ground terminal; and a diode having an anode connected to the energy recovery unit and a cathode connected to a sustain discharge voltage terminal.

7. An energy recovery circuit for a plasma display panel (PDP). comprising:

an energy recovery unit recovering and storing energy from a PDP; and a switching stabilizing unit electrically connected to the energy recovery unit to stabilize switching of a sustain discharge pulse applied to the PDP wherein, the energy recovery unit comprises a capacitor for energy recovery, recovering and storing energy and an inductor preventing a rapid increase of current, a control switch storing recovery energy and a control switch supplying discharge energy are connected in parallel between the capacitor and the inductor, and diodes for preventing reverse current are connected in series to the respective control switches; and the switching stabilization unit comprises an external input voltage source electrically connected to the energy recovery unit to supply an external voltage.

8. The energy recovery circuit as set forth in claim 7, wherein, when recovered energy is supplied to the PDP, the capacitor for energy recovery and the external input voltage source are connected in series, so that the energy is supplied to the PDP through one path.

9. The energy recovery circuit as set forth in claim 7, wherein two switches are connected in parallel between the capacitor for energy recovery and a ground voltage (GND), and any one of the two switches is electrically connected to the external input voltage source.

10. The energy recovery circuit as set forth in claim 9, wherein any one of the two switches further comprises a capacitor (CR2) for charging an external voltage connected in parallel with the external input voltage source, and a diode (D33) for preventing reverse current is connected in series to the external input voltage source.

11. The energy recovery circuit as set forth in claim 7, wherein:

the external input voltage source and the capacitor (CR2) for charging an external voltage are connected in parallel between the control switch for supplying recovery energy and the ground voltage (GND), the diode (D3) for preventing reverse current is connected in series between the external input voltage source and the control switch for supplying recovery energy, and a first switch (SW6) is connected in series between the capacitor (CR2) for charging an external voltage and the ground voltage (GND); and a node between the capacitor (CR2) for charging an external voltage and the first switch (SW6), connected in series, is connected through the control switch for storing recovery energy and a second switch (SW5).

12. The energy recovery circuit as set forth in claim 7, wherein the external input voltage source is a data voltage (Vdata) applied to a data electrode for address discharge.

* * * * *